US007169992B1

(12) United States Patent
Kennon

(10) Patent No.: US 7,169,992 B1
(45) Date of Patent: Jan. 30, 2007

(54) GUITAR STRAP

(76) Inventor: John Kennon, 3127 Sunnydale Dr., Napa Valley, CA (US) 94558

( * ) Notice: Subject to any disclaimer, the term of this patent is extended or adjusted under 35 U.S.C. 154(b) by 0 days.

(21) Appl. No.: 11/168,147

(22) Filed: Jun. 27, 2005

Related U.S. Application Data

(63) Continuation of application No. 10/394,109, filed on Mar. 21, 2003, now abandoned.

(51) Int. Cl.
*G10D 3/00* (2006.01)

(52) U.S. Cl. ..... 84/327

(58) Field of Classification Search ..... 84/327, 84/329; 224/264, 257, 258
See application file for complete search history.

(56) References Cited

U.S. PATENT DOCUMENTS 3,323,698 A * 6/1967 Sottile ..... 224/264
3,601,863 A * 8/1971 Dorsey ..... 24/16 PB
3,696,443 A * 10/1972 Taylor ..... 2/114
4,045,058 A * 8/1977 Eross ..... 285/119
4,254,901 A * 3/1981 McIntosh ..... 224/258
4,291,822 A * 9/1981 Simonds ..... 224/257
5,131,151 A * 7/1992 Agase et al. ..... 30/327
6,708,838 B1 * 3/2004 Bergman et al. ..... 220/757

* cited by examiner

*Primary Examiner*—Kimberly Lockett
(74) *Attorney, Agent, or Firm*—Goldstein Law Offices PC

(57) ABSTRACT

A guitar strap, for supporting a guitar, having a guitar body, and a pair of attachment knobs affixed to the guitar body. The attachment knobs have a neck and a flange, the flange larger in diameter than the neck. The guitar strap has a belt having a first and second end, and a pair of connecting pads, each connecting pad located at one of the first and second ends of the belt. The connecting pads each have a securing hole having a securing hole circumference, which has a relaxed, smaller size, but when pressed down upon one of the attachment knobs enlarges and allows the flange to pass therethrough, and then relaxes and retracts to extend snugly around the neck once the connecting pad has been moved below the flange.

5 Claims, 3 Drawing Sheets

GUITAR STRAP

CROSS REFERENCES AND RELATED SUBJECT MATTER

This application is a continuation of patent application Ser. No. 10/394,109, filed in the United States Patent Office on Mar. 21, 2003 now abandoned.

BACKGROUND OF THE INVENTION

The invention relates to a guitar strap. More particularly, the invention relates to a guitar strap that is configured to easily attach onto guitar attachment knobs standardly mounted on a guitar.

A typical acoustic guitar is geometrically configured so that it can be easily played while seated with the guitar cradled upon one knee. A great deal of modern guitar playing, however, is carried out while standing. Since guitar playing requires two hands: one hand to pick or strum the strings, while the other presses selected strings against the fret-board—it is necessary to independently support the guitar while standing.

Thus, to allow the guitar player to support the guitar while freeing both hands for playing, a guitar strap is conventionally attached between two 'attachment knobs' that are located on opposite ends of the guitar body. The attachment knobs have a flange and a neck. The guitar strap has opposite ends which are typically made of leather and each have a hole similar in size to the neck, and a diametric slit which allows the hole to be worked over the attachment knobs. Once in place, the strap supports the guitar by holding each of the attachment knobs transversely at their necks.

In time, however, the edges between the hole and diametric slit tend to fray or curl. At that point, it becomes more likely that one of the attachment knobs will pull out of the hole, freeing the strap from that attachment knob. If at that time the strap is in use, supporting the guitar, the results can be disastrous. Unfortunately, it is very difficult to judge a strap that is still in good condition from one that might drop the guitar at any moment.

In addition, attaching the conventional strap requires significant dexterity, and can be a clumsy undertaking. When playing guitar professionally, simplicity is demanded as well as ease of attachment and detachment—especially when on-stage.

Over the years, others have sought alternatives to the traditional guitar strap. While these units may be suitable for the particular purpose employed, or for general use, they would not be as suitable for the purposes of the present invention as disclosed hereafter.

SUMMARY OF THE INVENTION

It is an object of the invention to produce a guitar strap that quickly and easily fastens onto a guitar. Accordingly, the strap has a pair of connecting pads that are connected by a belt, wherein each of the connecting pads are mateable with the attachment knobs on a guitar.

It is a further object of the invention to provide a guitar strap that has a long useful life and eliminates the shortcomings that accompany 'slit-based' connection schemes. Accordingly, each of the connecting pads have a securing hole extending therethrough which is substantially the size of the neck of an a standard attachment knob, yet is not bordered by any slit. To facilitate attachment onto the knob, the connecting pads are made of a resilient, elastic, stretchable material such as rubber, so that the securing hole is stretched over the knob, expands to accommodate and extend the flange of the attachment knob fully therethrough, and then snaps back around the neck.

It is yet a further object of the invention to provide a guitar strap that will remain securely mated with the attachment knobs on a guitar while supporting the same, but is easily removed when desired. Accordingly, the substantially longitudinal forces exerted by the belt upon the connecting pad to support the attachment knobs will not substantially deform the securing hole or otherwise present an undesired opportunity for the attachment knob to pull out from the connecting pads. However, when removal of the strap is desired, a transverse force exerted by the user upon the connecting pad, especially interfacing the circumference of the securing hole against the flange, will once again allow the securing hole to expand to allow removal of the connecting pad from the attachment knob, and thus the guitar strap from the guitar.

The invention is a guitar strap, for supporting a guitar, having a guitar body, and a pair of attachment knobs affixed to the guitar body. The attachment knobs have a neck and a flange, the flange larger in diameter than the neck. The guitar strap has a belt having a first and second end, and a pair of connecting pads, each connecting pad located at one of the first and second ends of the belt. The connecting pads each have a securing hole having a securing hole circumference, which has a relaxed, smaller size, but when pressed down upon one of the attachment knobs enlarges and allows the flange to pass therethrough, and then relaxes and retracts to extend snugly around the neck once the connecting pad has been moved below the flange.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
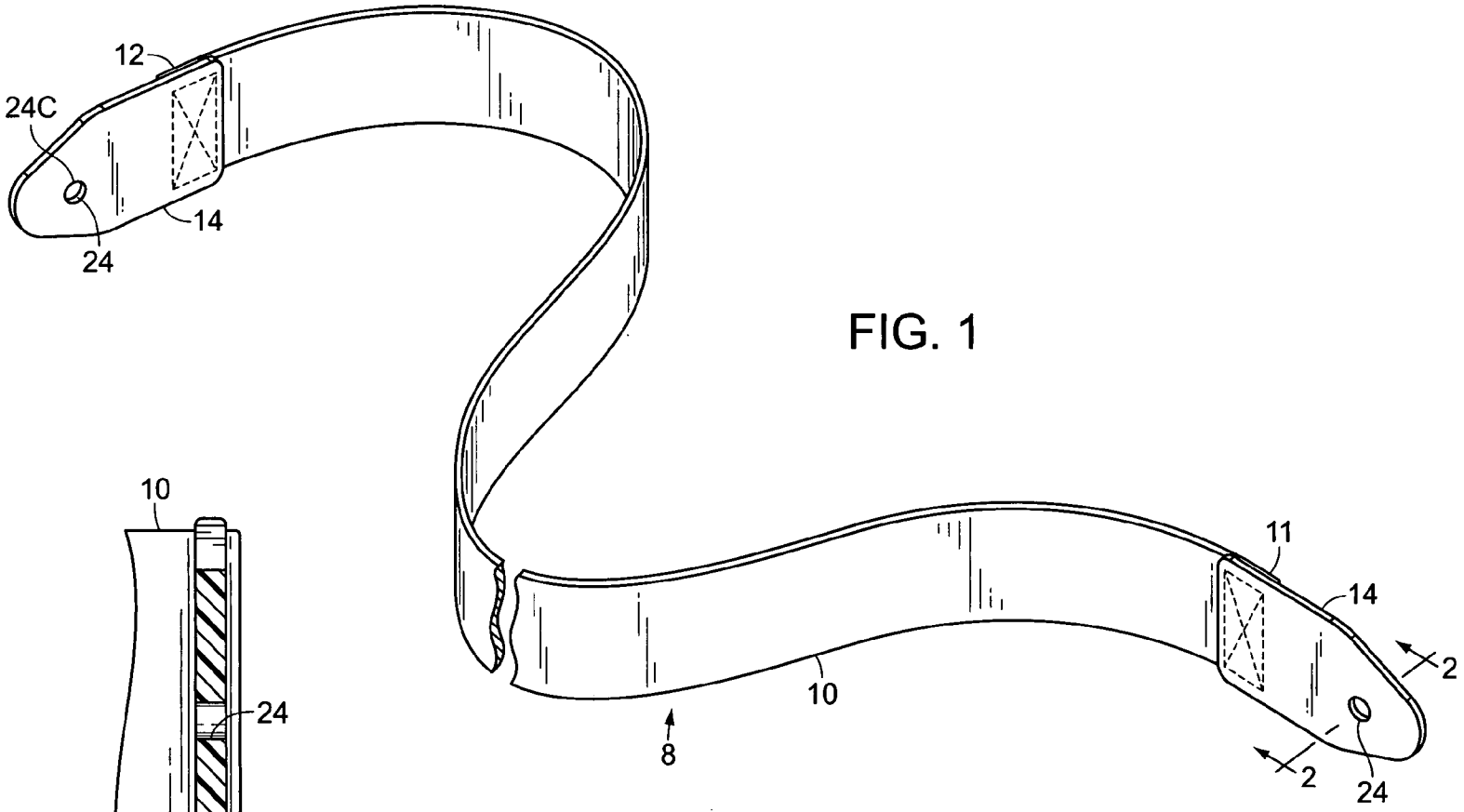
FIG. 1 is a diagrammatic perspective view of the guitar strap according to the present invention, per se.

FIG. 1 illustrates a guitar strap 8, including a belt 10 having a first end 11 and a second end 12. The belt 10 is substantially thin and broad, and may be made of a woven fabric, or other materials employed with standard guitar straps. In addition, the belt has a length, defined substantially by the distance between the first end 11 and second end 12, which is similar to typical guitar straps, and may be made to be adjustable in length in a conventional manner. A pair of connecting pads 14 are attached to the belt 10, one at the first end 11, and the other at the second end 12. The connecting pads 14 are substantially planar and thin, and may partially overlap the belt 10 inwardly of the first end 11 and second end 12, for parallel attachment of the connecting pads 14 with the belt 10 thereat.

Figure 2:
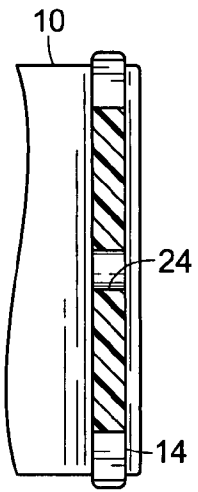
FIG. 2 is a cross sectional view, taken generally in the area of line 2—2 in FIG. 1, showing at least a portion of the connecting pad that surrounds the securing hole is made of an elastic material such as rubber.
Figure 3:
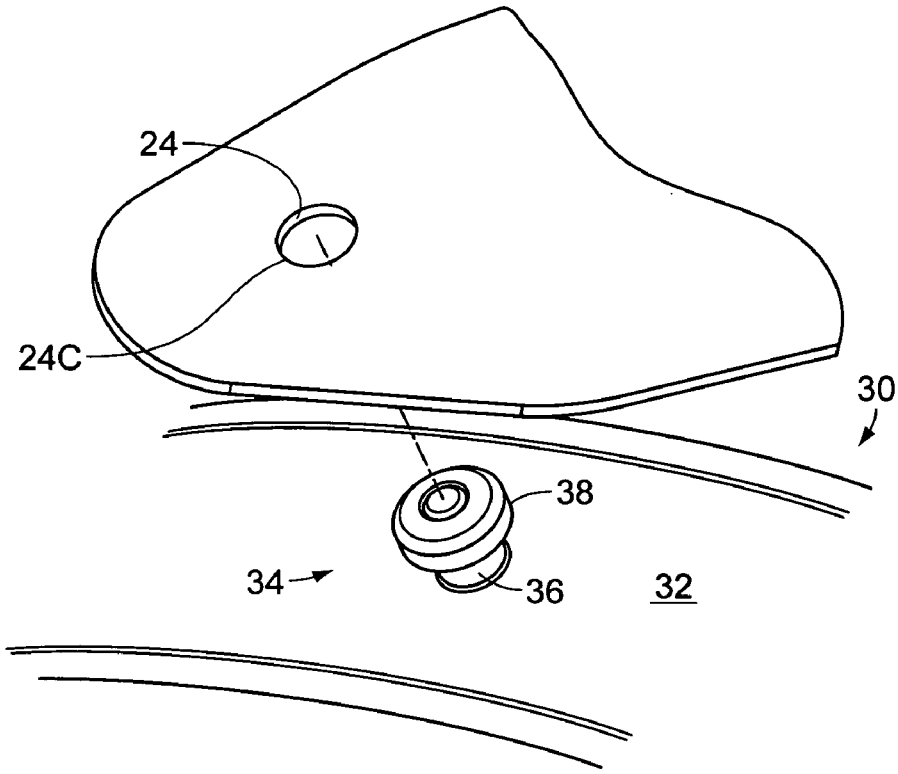
FIG. 3 is a diagrammatic perspective view, illustrating the invention in use, wherein one of the connecting pads is about to be mated with one of the attachment knobs on a guitar body.

Referring to FIG. 1 and FIG. 2, each of the connecting pads has a first surface 21 and an opposite second surface 22 that is parallel to the first surface 21. Each connecting pad has a securing hole 24 extending fully therethrough between the first surface 21 and the second surface 22. According to the present invention, the securing hole 24 has a circumference 24C that is circular and continuous, and is not bordered by a radial slit, or any other slit surrounding the same. Further in accordance with the present invention, the connecting pad 14 surrounding the securing hole 24 is made of an elastic, stretchable, resilient material, such as rubber, which allows the securing hole 24 to expand in size. As illustrated in FIG. 1, FIG. 2, and FIG. 3 that will be discussed momentarily, the securing hole 24 is at a relaxed, smaller diameter.

Referring now to FIG. 3, a portion of a guitar 30 having a guitar body 32 is illustrated. In particular, the guitar 30 has a pair of attachment knobs 34—only one of which is illustrated. Each attachment knob 34 has a neck 36 immediately adjacent to the guitar body 32 having a neck diameter, and has a flange 38 substantially concentric with the neck 36 and having a flange diameter that is larger than the neck diameter.

Still referring to FIG. 3, in accordance with the present invention, the strap 8 is about to be attached to the guitar body 32 at a side surface thereof by attaching one of the connecting pads 14 of the strap 8 to one of the attachment knobs 34 affixed to or forming a part of the guitar body 32. In particular, the securing hole 24 is about to be extended over the attachment knob. As illustrated, the securing hole 24 is not large enough to extend over the flange 38, since it is at its relaxed, smaller diameter. The strap is being grasped by a user, having a pair of thumbs 40, wherein the thumbs are both positioned upon the first surface 21 of the connection pad 14, on opposite sides of the securing hole 24.

Figure 4:
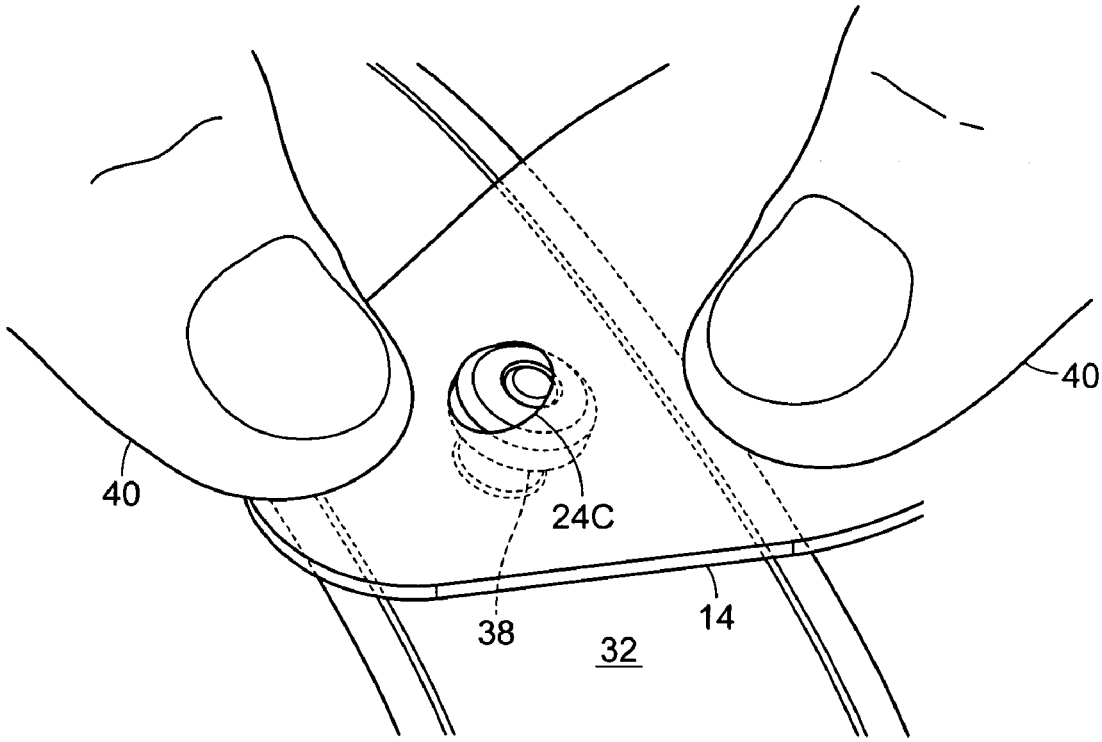
FIG. 4 is a diagrammatic perspective view, similar to FIG. 3, except wherein the securing hole is introduced onto the flange of the attachment knob is pressure is being applied downwardly thereagainst by a user.

Now, in FIG. 4, the strap 8 has been moved downward, wherein the second surface 22 of the connecting pad 14 is being pushed against the attachment knob 34. More particularly, the securing hole is being pressed against the flange 38 of the attachment knob 34 by the downward pressure of the thumbs 40 upon the first surface 22 of the connecting pad 14 adjacent to the securing hole circumference 24C toward the guitar body. In response to this pressure, being applied almost directly against the circumference 24C of the securing hole 24, the connecting pad 14 undergoes elastic deformation, such that securing hole 24 enlarges. As further illustrated in FIG. 5, the securing hole 24 enlarges to at least the size of the flange 38 so that the securing hole 24 is at a tensioned, larger diameter.

Figure 5:
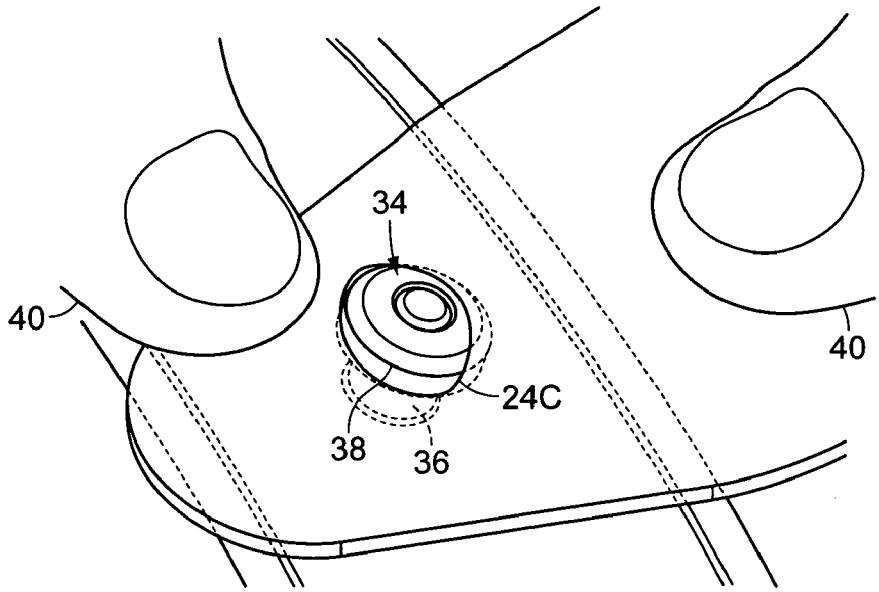
FIG. 5 is a diagrammatic perspective view, similar to FIG. 4, except wherein the downward pressure of the user upon the connecting pad has stretched the connecting pad and thereby enlarged the securing hole so that it is partially extended around the neck of the attachment knob.
Figure 6:
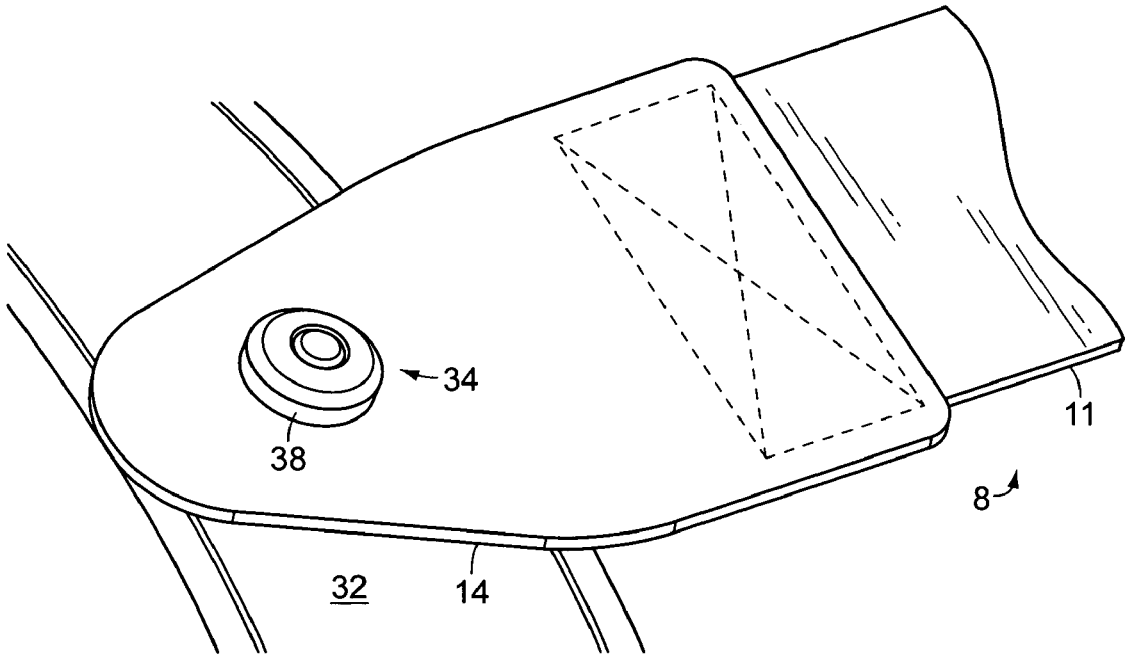
FIG. 6 is a diagrammatic perspective view, similar to FIG. 5, except wherein the connecting pad had been moved downward such that it is fully below the flange and the securing hole has elastically retracted so that it now extends snugly around the attachment knob neck.

Referring then to FIG. 5 and FIG. 6, with the securing hole 24 enlarged so that the attachment knob 34 can fit within its circumference 24C, the connecting pad 14 is pressed downward until the flange 38 extends fully through the securing hole and the connecting pad 14 if fully below the flange 38. Accordingly, the securing hole 24 extends around the neck 36. Since the securing hole 24 was deformed elastically, it will quickly 'snap back' to its relaxed smaller diameter. Thus, the neck 36 will fit snugly within the securing hole.

Of course, the attachment procedure illustrated in FIGS. 3 through 6 is repeated for the ubiquitous, 'other' attachment knob 34 at an opposite side of the guitar body 32. The user can then safely support the guitar 30 by extending the belt 10 over his/her neck and shoulders. During normal usage of the guitar strap 8, the weight of the guitar 30 is translated into longitudinal tension in the belt 10 transverse to the neck. Accordingly, during ordinary usage of the guitar strap 8 the lateral forces exerted against the connecting pad 14 will not deform the securing hole, and therefore will not enlarge the same sufficiently to allow the flange 38 to pass therethrough. Removal of the guitar strap 8 simply involves pulling each connecting pad 14 upward to once again enlarge its associated securing hole 24 and allow the flange 38 to pass therethrough. That perpendicular forces are experienced by the securing hole 24 during attachment and removal—as opposed to during support of the guitar body with the strap—removal of the strap need be intentional. Accordingly the present invention is configured to avoid the connecting part 14 of the strap 10 from inadvertently detaching from the attachment knobs 34.

In conclusion, herein is presented a system for providing a guitar strap which easily attaches to the attachment knobs on a guitar body, will remain securely attached thereto while the strap is used to support the guitar body, and is easily removed when desired. The invention is illustrated by example in the foregoing description and in the accompanying drawing figures. Numerous variations are possible while adhering to the inventive concept. Such variations are contemplated as being a part of the present invention.

What is claimed is:

1. A guitar strap, for attaching to a guitar body having a pair of attachment knobs, each attachment knob having a neck immediately adjacent to the guitar body, and a flange having a larger diameter than the neck, comprising:

a belt, having a first end and second end, sized for extending over the neck and shoulders of a user;

a pair of connecting pads, one of said connecting pads attached to the belt at the first end and the other attached to the belt at the second end, each connecting pad having a first surface, a second surface parallel to the first surface, and having a securing hole extending between the first surface and second surface, the securing hole substantially circular having a continuous circumference with no slit connected with the circumference, the connection pad made of an elastic material at the securing hole, the securing hole having a relaxed smaller diameter, the securing hole may be elastically deformed such that it may be enlarged to extend over the flange of the guitar attachment knob, and will return to the relaxed smaller diameter once the connection pad is below the flange such that the securing hole circumference extends snugly around the neck of the attachment knob.

2. The method of supporting a guitar having a guitar body and a pair of attachment knobs affixed to the guitar body, each attachment knob having a neck adjacent to the body and a flange attached to the neck which is larger in diameter than the neck, using the guitar strap having a belt having a first end and second end and connecting pads attached to the first and second ends, each connecting pad having a securing hole having a securing hole circumference, comprising the steps of:

a. positioning the securing hole of one of the connection pads against the flange of one of the attachment knobs;
b. enlarging the securing hole by pressing the connection pad adjacent to the securing hole circumference downwardly against the flange;
c. moving the enlarged securing hole downward over the flange to the neck;
d. snugly engaging the neck with the securing hole by relaxing the securing hole and elastically reforming the securing hole;
e. repeating steps (a) through (d) for the other of the attachment knobs and on the guitar body with the other of the connection pads; and
f. supporting the guitar body by extending the belt over the user.

3. The guitar supporting method as recited in claim 2, wherein each connecting pad is made of a resilient material surrounding the securing hole, wherein the securing hole is substantially circular and its circumference is continuous and closed.

4. The guitar supporting method as recited in claim 3, wherein each connecting pad has a first surface and a parallel second surface, wherein the step of positioning one of the connection pads against the flange further comprises positioning the second surface of said connection pad against the flange, and wherein the step of pressing the connection pad adjacent to the securing hole circumference downwardly against the flange further comprises pressing the first surface downwardly toward the guitar body.

5. The guitar supporting method as recited in claim 4, further comprising the step of removing each connecting pad from its associated attachment knob comprises enlarging the securing hole by pulling the connection pad upwardly against the flange.

* * * * *